US006481952B2

(12) United States Patent
Deutschle et al.

(10) Patent No.: US 6,481,952 B2
(45) Date of Patent: Nov. 19, 2002

(54) METHOD OF AND APPARATUS FOR ACCUMULATING SUCCESSIVE STACKS OF SUPERIMPOSED SHEETS

(75) Inventors: Robert Deutschle, Horst (DE); Norbert Rilitz, Norderstedt (DE)

(73) Assignee: E.C.H. Will GmbH, Hamburg (DE)

( * ) Notice: Subject to any disclaimer, the term of this patent is extended or adjusted under 35 U.S.C. 154(b) by 0 days.

(21) Appl. No.: 10/022,840

(22) Filed: Dec. 20, 2001

(65) Prior Publication Data

US 2002/0084578 A1 Jul. 4, 2002

Related U.S. Application Data

(63) Continuation of application No. PCT/EP00/04689, filed on May 23, 2000.

(30) Foreign Application Priority Data

Jun. 21, 1999 (DE) ..... 199 28 367

(51) Int. Cl.[7] ..... B65H 31/32; B65H 29/00; B65H 31/30; B65H 31/00

(52) U.S. Cl. ..... 414/790.8; 414/789.5; 414/789.9; 271/211

(58) Field of Search ..... 414/790.8, 789.5, 414/793, 793.1, 789.9; 271/211, 218

(56) References Cited

U.S. PATENT DOCUMENTS

| | | | | |
|---|---|---|---|---|
| 2,853,299 A | | 9/1958 | Link et al. | |
| 4,796,879 A | * | 1/1989 | Martini et al. | 271/218 |
| 5,664,767 A | * | 9/1997 | Voss | 271/189 |

FOREIGN PATENT DOCUMENTS

| | | |
|---|---|---|
| DE | 942 947 | 11/1955 |
| DE | 943 772 | 12/1955 |
| DE | 1 230 810 | 12/1966 |
| DE | 29 42 965 A1 | 5/1981 |
| DE | 36 16 470 A1 | 6/1987 |
| EP | 0 270 943 A1 | 6/1988 |
| EP | 0 773 179 A2 | 5/1997 |
| EP | 0 845 431 A2 | 6/1998 |

OTHER PUBLICATIONS

Brown, Kevin P., Counter–Ejector, Jun. 27, 2002, United States Patent Application Publication, US 2002/0081188 A1.*

* cited by examiner

*Primary Examiner*—Christopher P. Ellis
*Assistant Examiner*—Michael J. Kwon
(74) *Attorney, Agent, or Firm*—Venable; Robert Kinberg

(57) ABSTRACT

Apparatus for accumulating successive stacks of superimposed sheets on discrete pallets employs a conveyor which delivers a continuous imbricated stream of sheets to a stacking station where a pallet descends with an elevator and gathers a first stack. A separating finger is inserted into the accumulation of sheets at the stacking station at a level above the topmost sheet of the fully grown first stack. The thus obtained gap is increased by lowering the finger at a speed less than that of the elevator, the increased gap receives a positioning member which attracts the lower part of the growing second stack by suction, a table is inserted into the increased gap between the partitioning member and the fully grown stack, the fully grown stack and its pallet are withdrawn from the stacking station and replaced with a fresh pallet, the table and the partitioning member are withdrawn from the stacking station so that the growing second stack descends onto the second pallet, and the above-enumerated sequence of steps is tereupon repeated.

25 Claims, 10 Drawing Sheets

METHOD OF AND APPARATUS FOR ACCUMULATING SUCCESSIVE STACKS OF SUPERIMPOSED SHEETS

CROSS-REFERERNCE TO RELATED CASES

The present application is a continuation of pending International Application No. PCT/EP00/04689 filed May 23, 2000, and designating the United States. The parent International Application and the present continuation both claim priority of commonly owned copending German Patent Application No. 199 28 367.2 filed Jun. 21, 1999. The disclosure of the aforementioned International Application and the priority application, as well as that of each US and foreign patent and patent application identified in the specification of the present application, is incorporated herein by reference.

BACKGROUND OF THE INVENTION

"This application is a continuation division of international application number PCT/EP00/04689, filed May 23, 2000 (status, abandoned, pending, etc.)."

The present invention relates to improvements in methods of and in apparatus for manipulating sheets of paper, cardboard, metallic foil, plastic material or the like. More particularly, the invention relates to improvements in methods of and in apparatus for accumulating successive stacks of superimposed sheets on discrete supports in the form of platforms such as pallets or the like. Still more particularly, the invention relates to improvements in methods of and in apparatus for introducing empty supports (hereinafter called platforms or pallets) into and for withdrawing or otherwise removing filled pallets from a stacking station wherein a continuously advancing layer or stream of sheets is converted into a succession of stacks or piles reach containing a preselected number of superimposed sheets and each supported by a discrete pallet.

It is already known to introduce into a stacking station successive empty pallets at intervals which are required to gather on each empty pallet a stack or pile of superimposed sheets or to place onto each introduced empty pallet a fully grown stack of superimposed sheets. Empty pallets must be introduced at a rate and in a manner to ensure that they cannot interfere with movements of preceding pallets at, and with evacuation of preceding (loaded) pallets from, the stacking station.

Successive sheets of a stream or flow of sheets are normally obtained by repeatedly severing a running strip or web of paper, foil or the like and by feeding successive sheets from the severing station to a stacking station. The apparatus at the stacking station is arranged to convert the stream into a succession of discrete stacks each of which contains a predetermined number of superimposed sheets and each of which is supported by a discrete pallet. Filled or loaded pallets must be withdrawn from the stacking station in a manner and at a rate to permit for the introduction of empty pallets in good time to ensure that each introduced empty pallet can receive a growing stack or a fully grown stack following the finished stack on the loaded pallet. Problems which arise in conventional aparatus are attributable, either primarily or exclusively or to a certain extent, to the fact that the stacking apparatus receives or should receive or can receive a continuous (uninterrupted) flow or stream of discrete sheets which are or which can be partly superimposed upon each other. The formations of sheets in a series or flow of partially overlapping sheets are known as imbricated patterns.

German patent application Serial No. 36 16 470 A1 (filed by Martini et al. on May 15, 1986 and published Jun. 26, 1987) discloses a method of and an apparatus for accumulating successive piles of superimposed sheets at a stacking station. The apparatus is intended to ensure a reasonably problem-free evacuation of filled pallets from and a reasonably problem-free introduction of empty pallets to the stacking station. Successive sheets of the imbricated stream of partly overlapping sheets are fed into the stacking station by an endless belt conveyor and are gathered on a descending first pallet in such a way that each preceding sheet is fully overlapped by the next-following sheet. A separating finger is thereupon introduced into the stacking station to overlie the topmost sheet of the completed stack and to be overlapped by the first (lowermost) sheet of the next-following (growing) stack. The inserted finger descends at a speed less than that of the pallet and of the fully grown stack on the pallet to thus cause the formation of a clearance between the topmost sheet of the finished stack and the lowermost sheet of the growing stack. The clearance receives a first clamping jaw and the finger is thereupon withdrawn and lifted to a level above the topmost sheet of the next fully grown stack. The just described sequence of steps is thereupon repeated, i.e., the finger is introduced into the pile of superimposed sheets at a level such that it is located above the number of sheets piled up above the first clamping jaw and required to form a second fully grown stack above the stack below the inserted first clamping jaw (i.e., above the stack on the pallet). The thus inserted separating finger is again caused to descend at a speed less than that of the descending fully grown stack on the pallet. The thus obtained fresh (second) clearance receives a second clamping finger. The second fully grown stack (namely the stack between the two clamping jaws) is thereupon clamped by such jaws in that one of the jaws is moved toward the other jaw.

In a next-following step, the lower clearance is enlarged in that the pallet and the fully assembled stack thereon are lowered so that the lower clearance can receive a table which intercepts the clamping jaw and the (second) stack between the two clamping jaws. This renders it possible to evacuate the pallet and the fully grown stack thereon from the stacking station and to introduce an empty pallet which receives and supports the second fully grown stack, This involves the withdrawal of the table and a lowering of the clamped stack so that the first clamp is immediately adjacent the introduced empty pallet. The second clamp is lifted slighty above and further away from the first clamp to thus release the fully grown second stack. A lowering of the first clamp is not possible because this clamp is immediately adjacent the freshly introduced second pallet. The first clamp is thereupon withdrawn so that the second stack can descend onto the second pallet, the second clamp is withdrawn in a next-following step and the aforedescribed sequence of steps is thereupon repeated in connection with the second pallet, the second stack and a third stack which is being or which has been gathered above the second stack.

A drawback of the just described conventional method and apparatus is that the number of steps to be carried out in connection with the gathering and removal of successive stacks is rather high as well as that the apparatus is bulky and its manipulation must be effected by resorting to a complex control system. Furthermore, the frequency at which filled pallets can be withdrawn from, and empty pallets can be introduced into, the stacking station has a relatively low upper limit.

OBJECTS OF THE INVENTION

An object of the invention is to provide a novel and improved method of gathering successive stacks or piles of superimposed sheets at a stacking station and of manipulating the supports (such as platforms or pallets) for the stacks in a manner which is simpler than but at least as reliable as heretofore known undertakings.

Another object of the present invention is to provide a method which can dispense with the step of clamping successively gathered fully grown stacks of sheets between pairs of clamping jaws or the like.

A further object of the invention is to provide a method which can dispense with the step or steps of lifting any parts which are inserted into the accumulation of superimposed sheets at the stacking station.

An additional object of the present invention is to provide a novel and improved apparatus for the practice of the above outlined method.

Still another object of the invention is to provide an apparatus which need not employ clamping jaws for fully grown stacks of sheets at the stacking or gathering station.

A further object of the invention is to provide an apparatus which is simpler, more compact and less expensive than heretofore known apparatus for palletizing stacks of paper sheets or the like.

Another object of the invention is to provide novel and improved means for establishing and varying the dimensions of clearances in the accumulation of superimposed sheets at the stacking station.

An additional object of the invention is to provide novel and improved distancing means for use between the piles of sheets at the stacking station of the above outlined apparatus.

Still another object of the invention is to provide the apparatus with novel and improved means for reliably positioning certain sheets of the accumulation of sheets at the stacking station relative to the parts which are movable into and withdrawable from the stacking station and/or relative to the parts which are fixedly mounted at the stacking station.

A further object of our present invention is to provide a novel and improved method of and a novel and improved apparatus for converting an imbricated stream of large or small sheets of metallic, plastic or other suitable material into a succesion of stacks each of which contains or can contain a desired number of superimposed sheets.

Another object of the instant invention is to provide a novel and improved stack building and manipulating apparatus which can be utilized as a superior substitute for heretofore known apparatus serving to palletize stacks or analogous accumulations of superimposed sheets which can be utilized for the wrapping of various types of commodities as well as for numerous other purposes.

SUMMARY OF THE INVENTION

One feature of the present invention resides in the provision of a method of supplying platforms (such as pallets) for stacks of a series of succesive sheets of paper, cardboard, metallic foil, plastic material or the like which are supplied to and are superimposed upon each other at a stacking station. The improved method comprises the step of depositing successive sheets of the series upon a first platform at the stacking station to thus accumulate on the first platform a first stack of superimposed sheets. The depositing step can be carried out by resorting to an endless belt conveyor having a upper reach which delivers successive sheets of the series from a source to the stacking station. On their way from the source to the stacking station, the sheets of the series can partially overlap each other and the source can include a device which repeatedly severs a continuous web of sheet material being supplied from a bobbin or the like.

The depositing step includes lowering the first platform with the growing stack thereon and the method further comprises the steps of introducing a stack separating member sideways between the topmost sheet of the first stack and the next-following sheet of the series when the number of sheets in the first stack reaches a preselected number; utilizing the separating member to establish between the topmost sheet of the first stack and the next-following sheet of the series of sheets at the stacking station a gap; inserting a partitioning member between the separating member and the next-following sheet (the lowermost sheet of the growing stack) of the series; withdrawing the separating member from the stacking station so that the next-following sheet of the series (i.e., the lowermost sheet of the then growing stack) is free to descend onto the partitioning member; attracting the next-following sheet to the partitioning member by suction; increasing the width of the gap between the partitioning member and the first stack (this can be readily achieved by moving the first stack and the first platform downwardly relative to the desceding partitioning member); advancing into the thus widened gap a distancing member; evacuating the first stack and the first platform from the stacking station; transporting into the stacking station a second platform beneath the distancing member; removing the distancing member from the stacking station; thereupon interrupting the attracting step; and retracting the partitioning member from the stacking station so that the next-following sheet and the sheets above the next-following sheet (i.e., the growing stack or the lowermost growing stack then located at the stacking station) can descend onto the second platform.

The depositing step can include conveying successive sheets of the series into the stacking station in a predetermined direction transversely of the direction of lowering the stacks of sheets at the stacking station (the conveying step can include advancing successive sheets of the series along a substantially horizontal path which ends at the stacking station), and the introducing step can include moving the separating member into the stacking station by advancing it in the predetermined direction.

The step of increasing the width of the gap can include lowering the first stack at the stacking station at a first speed and lowering the separating member at the stacking station at a second speed which is less than the first speed so that the descending separating member lags behind the descending first platform.

The inserting step can be carried out simultaneously with or can follow the withdrawing step.

The attracting step can include drawing air into openings which are provided in the at least partially hollow partitioning member. Such attracting step normally involves drawing the underside of the next-following sheet of the series (i.e., the underside of the lowermost sheet of the stack which is in the process of growing above the fully grown stack being borne by the first platform) to the upper side of an apertured panel forming part of the partitioning member.

The attracting step can be started upon completed deposition of at least one additional sheet of the series upon the just mentioned next-following sheet. The next-following sheet, the additional sheet and the sheets above the additional sheet (i.e., the sheets of the growing second stack) can be attracted to the partitioning member while the latter descends with but at a speed less than the speed of the first platform and of the fully grown (finished) stack on the first platform.

The depositing step can include propelling successive sheets of the series against a stop at the stacking station so that each sheet which reaches the stop is located at the stacking station, and the method can further comprise the step of temporarily attracting the thus propelled successive sheets to the stop by suction.

The distancing member can comprise a core which is movable into and from the stacking station and a cover which is movable with and relative to the core and includes a portion located between the core and the next-following sheet. The step of advancing the core and the cover of the distancing member into the widened gap can include moving the core into the widened gap and simultaneously moving the core relative to the cover in such a way that the speed of movement of the cover relative to the next-following sheet is zero or at least very close to zero.

The method can further comprise the step of establishing a film of compressed air or another suitable compressed gaseous fluid between the distancing member and the lowermost sheet of the only stack or the lowermost stack then growing at the stacking station.

Another feature of the present invention resides in the provision of an apparatus for supplying pallets or other suitable platforms for a series of successive sheets at a stacking station. The improved apparatus comprises means for conveying to the stacking station a series of successive sheets which are superimposed upon each other on arrival at the stacking station, an elevator which is arranged to suport a platform at the stacking station and to lower the platform thereon at a predetermined speed so that a growing stack of superimposed sheets supplied by the conveying means onto the platform descends therewith at the stacking station, a separating member which is arranged to be introduced into the stacking station between the uppermost sheet of a fully grown stack on the platform and the lowermost sheet of a growing next-following stack, means for lowering the introduced separating member at a speed less than the predetermined speed to thus establish a growing gap between the uppermost sheet of the fully grown stack and the lowermost sheet of the growing next-following stack, a partitioning member which is movable between a first position adjacent to and a second position within the gap as well as downwardly in the gap at a speed less than the predetermined speed to thus further increase the width (height) of the gap, means for temporarily attracting the lowermost sheet of the next-following stack to the partitioning member, and a distancing member which is movable between a first position adjacent to and a second position in the increased gap below the partitioning member.

The conveying means is or can be arranged to supply to the stacking station an at least substantially continuous series of sheets, and the attracting means can include openings provided in the partitioning member and arranged to attract sheets at the stacking station to at least one selected portion of the partitioning member. The partitioning member can include mutually inclined sections. One of the sections has an upper side and the attracting means can further include at least one suction chamber provided in the partitioning member. The aforementioned openings can include suction ports provided in the upper side of the one section of the partitioning means, communicating with the at least one suction chamber and being arranged to attract the underside of the lowermost sheet of the next-following stack at the stacking station. The openings can include ports which are arranged to attract one side of the next-following (growing) stack at the stacking station.

The improved apparatus can further comprise means for urging sheets away from the partitioning member during certain stages of operation of the apparatus, e.g., preparatory to withdrawal of the partitioning member from the gap. Such urging means can be designed in such a way that it includes certain parts of the attracting means. For example, the urging means can include a source of compressed air which is arranged to supply compressed air to openings forming part of the attracting means and provided in the partitioning member.

The distancing member can be provided with openings which confront the underside of the lowermost sheet of the growing stack at the stacking station in the second position of the distancing member, and the apparatus utilizing such distancing member is further provided with means for supplying to the openings of the distancing member compressed air or another suitable compressed gaseous fluid in the second position of the distancing member and/or during movement of the distancing member from the second position to the first position. In accordance with a presently preferred embodiment, the distancing member includes a core which is provided with openings and a cover which overlies the openings of the core and is immediately adjacent the lowermost sheet of the growing stack at the stacking station in the second position of the distancing member as well as during movement of the distancing member from the second position to the first position. The cover is or can be impermeable to fluids. Such apparatus can further comprise means for moving the core and the cover relative to each other so that the speed of the cover relative to the lowermost sheet of the growing stack during movement of the core from its second position to its first position at least approximates zero speed.

The novel features which are considered as characteristic of the invention are set forth in particular in the appended claims. The improved apparatus itself, however, both as to its construction and the modes of assembling and operating the same, together with numerous additional important and advantageous features and attributes thereof, will be best understood upon perusal of the following detailed description of certain presently preferred specific embodiments with reference to the accompanying drawing.

DESCRIPTION OF PREFERRED EMBODIMENTS

Figure 1:
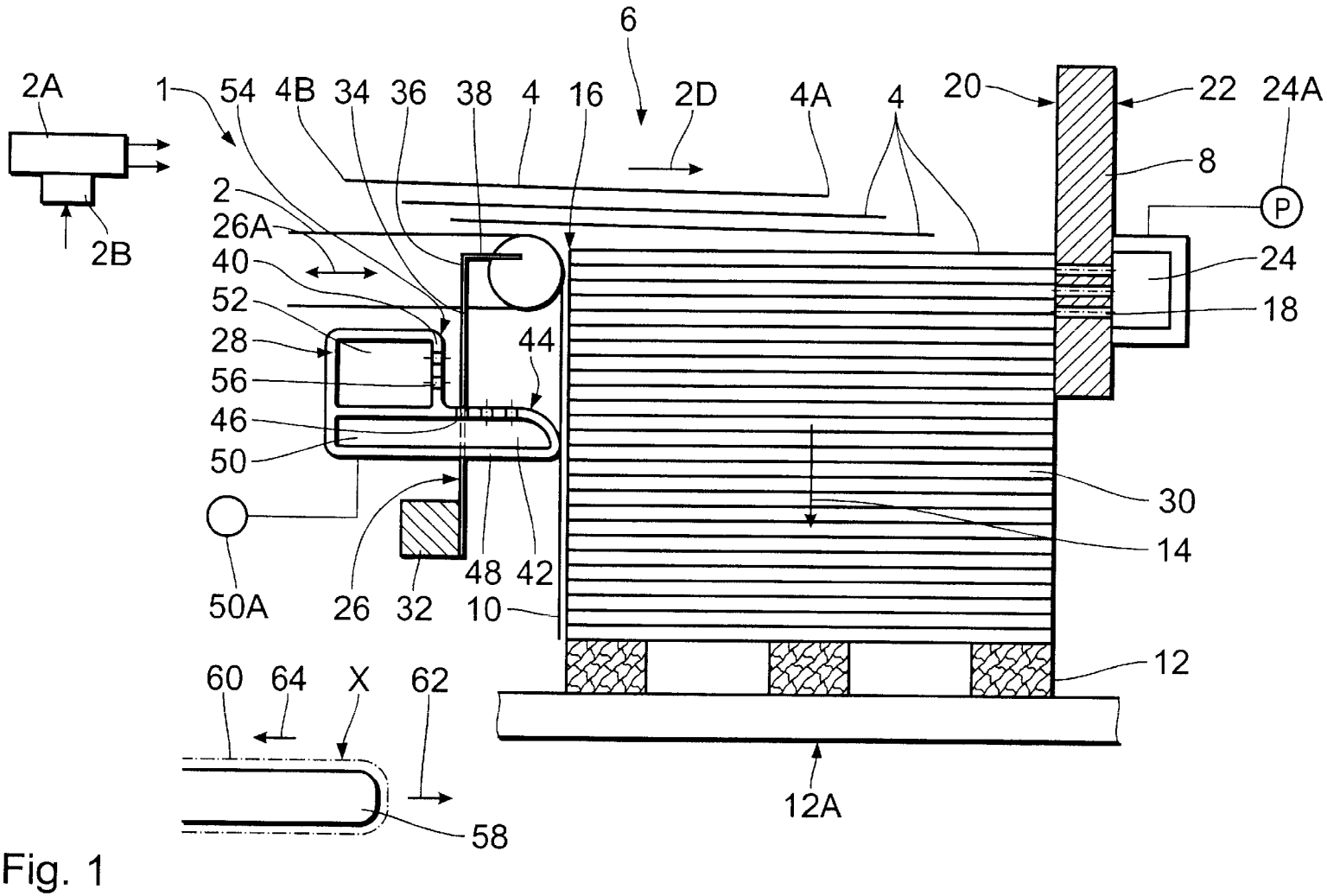
FIG. 1 is a schematic partly elevational and partly vertical sectional view of an apparatus which can be utilized for the accumulation of continuously supplied sheets into successive stacks or piles and wherein the means for ensuring predictable introduction of empty platforms and predictable evacuation of loaded platforms is constructed and assembled in accordance with one presently preferred embodiment of the invention, the parts of the apparatus being shown in positions they assume during accumulation of a stack of superimposed sheets on a platform which is carried by a descending elevator.

FIG. 1 illustrates certain relevant component parts of an apparatus 1 which is designed to accumulate a succession of stacks or piles of superimposed sheets 4 of paper, metallic foil, synthetic plastic material, cardboard or the like. The means for conveying successive sheets 4 of a series of sheets to a stacking station 6 and for depositing successive sheets first upon a first platform or pallet 12 comprises an endless flexible band, belt or chain conveyor 2 having an at least substantially horizontal upper reach or stretch which propels the sheets against the confronting sheet arresting and aligning upright surface 20 of a stop 8. The trailing ends of the sheets 4 which abut the surface 20 descend in the direction of an arrow 14 adjacent to or in actual contact with an upright aligning member 10, e.g., a wall, a plate or the like. The surface 20 and the confronting (right-hand) surface of the aligning member 10 in the apparatus 1 are preferably vertical or substantially vertical. The upper side of the illustrated pallet (first pallet) 12 is horizontal. The means for continuously or intermittently lowering the pallet 12 includes a suitable elevator 12A the exact details of which form no part of the present invention.

The operation of the elevator 12A is preferably such that it lowers the first pallet 12 at a rate corresponding to the rate of delivery of sheets 4 by the upper reach of the endless flexible conveyor 2 so that the level 16 of the uppermost sheet 4 of the growing stack 5 30 on the intermittently (stepwise) but preferably continuously descending growing stack 30 remains at least substantially constant. Otherwise stated, the level 16 of successive uppermost sheets 4 of the growing column at the stacking station 6 relative to the upper reach of the conveyor is constant (unchanged).

The stop 8 is provided with horizontal openings 18 in the form of bores, holes, channels or the like. Each such opening 18 extends from the upright sheet-arresting and aligning surface 20 to the other (rear or 45 outer) surface 22 of the stop 8. The character 24 denotes in FIG. 1 a suction chamber which is carried by or provided on or in the stop 8 and communicates with the adjacent ends of the openings 18. The means for establishing and maintaining in the suction chamber 24 an appropriate subatmospheric pressure includes a pump 24A or the like.

The aligning member 10 for the trailing ends of the sheets 4 in the stack 30 on the pallet 12 is provided with openings in the form of windows or the like for the passage of a substantially finger-like stack separating member 26 and of a partitioning member 28. Each of the members 26, 28 can enter into and can be withdrawn from the space bounded in part by the stop 8 and in part by the aligning member 10 and occupied by a growing or fully grown stack 30, i.e., from the actual stacking station 6.

The means for moving the separating member 26 (hereinafter called finger for short) back and forth in directions indicated by a double-headed arrow 26A includes a drive 32. The finger 26 is also movable up and down, i.e., in the direction indicated by the arrow 14 and counter to such direction. The arrangement is such that the finger 26 is movable (in the directions indicated by the arrows 14 and 26A as well as upwardly, as viewed in FIG. 1) independently of movements of all other parts in the apparatus 1; this finger is an inverted L-shaped member and includes a plate-like or rod-like upright section 34 which is operatively connected with and exends upwardly from the drive 32, and a horizontal or substantially horizontal partitioning section 38 extending from the upper end portion 36 of the section 34. The section 34 is or can be parallel to the upright aligning member 10, and the section 38 can extend through one of the aforementioned openings or windows in the aligning member 10.

Figure 2:
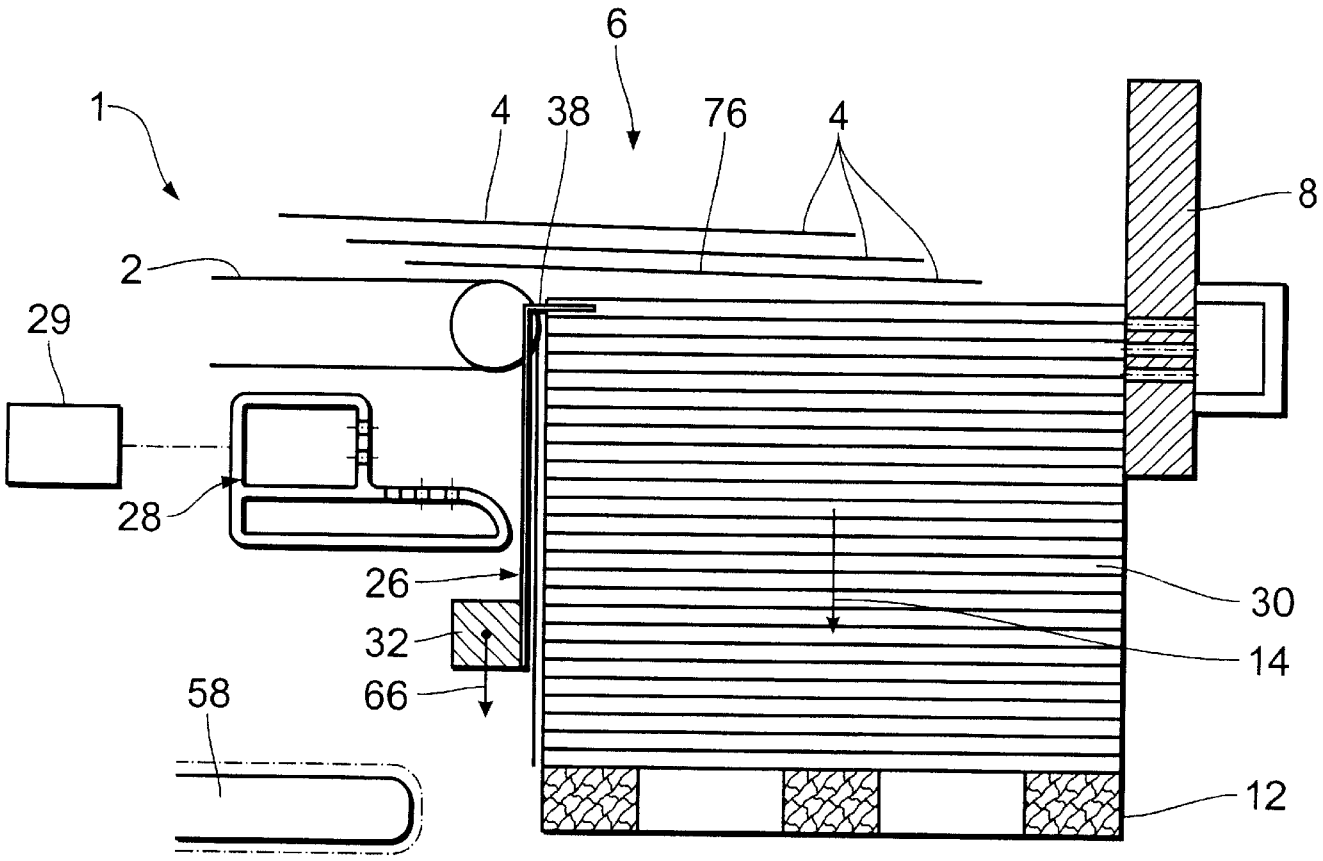
FIG. 2 shows the apparatus of FIG. 1 during that stage of operation which involves the introduction of a stack separating member between the topmost sheet of a fully grown stack on the platform and a growing second stack.

It will be appreciated that the superimposed or overlapping sheets 4 on the upper reach of the conveyor 2 and in the stack 30 actually contact each other, i.e., the illustrated relationships of these sheets are chosen solely for the convenience of reading the FIGS. 1, 2, etc. The sheets 4 on the upper reach or stretch of the conveyor 2 form an imbricated pattern and are caused to continuously advances toward the surface 20 of the stop 8 (see the arrow 2D).

The partitioning member 28 also constitutes a substantially L-shaped body having an upright section or component 40 which is at least substantially parallel to the aligning member 10. The horizontal lower section or component 48 of the partitioning member 28 (i.e., the section which is remotest from the conveyor 2) includes a hollow projection 42 which, in FIG. 1, extends at right angles to the upright section 40 toward the aligning member 10 and includes a rounded tip which can be introduced through one of the aforementioned openings in the aligning member 10 (see FIG. 3) to separate a fully assembled stack 30 from the next-following (growing) stack 76 (see FIGS. 3 to 7).

The horizontal upper panel 44 of the projection 42 of the lower section 48 is provided with openings or ports 46 which establish communication between an internal compartment or chamber 50 of the lower section 48 and the surrounding atmosphere. When the internal compartment 50 is connected with a suitable suction generating device (e.g., with the pump 24A or with an analogous pump), the upper panel 44 can attract a sheet 4 which overlies the panel 44 (see, for example, FIG. 3). The internal compartment 50 is further connectable with a source 50A of compressed air so that the openings 46 can discharge streamlets or jets of air; such streamlets flow through the panel 44 and urge the adjacent lowermost sheet 4 of the growing second stack 76 away from the projection 42 when the latter is received in the space between the stop 8 and the aligning member 10.

A second compartment or chamber 52 of the partitioning member 28 is adjacent an array of openings or ports 56 in the upright section 40 of the partitioning member. The second compartment 52 can communicate with the intake of a suction generating device (such as the pump 24*a* or a discrete pump, not shown, e.g., the pump which can draw air from the compartment 50). The openings 56 enable the member 28 to attract objects to the exposed side or surface of the section 40.

The apparatus 1 further comprises a mobile distancing member including a horizontal core or table 58 which is movable along an at least substantially horizontal path in and counter to the direction indicated by an arrow 62, i.e., in parallelism with the upper reach of the conveyor 2. The character 60 denotes an envelope or cover of textile material or the like which forms part of the distancing member and, in the illustrated embodiment of the apparatus 1, overlies the upper side and the underside of the table 58. The cover 60 is movable relative to the table 58 in the direction indicated by an arrow 64, preferably at a speed which matches the speed of the table 58 in the direction of the arrow 62. Thus, the table 58 and the cover 60 can move in directions and at speeds such that the position of a point X on the cover portion overlying the upper side of the table 58 remains unchanged in space, i.e., the distance from the point X to the plane of the upright aligning member 10 remains unchanged.

FIG. 1 shows the parts of the apparatus 1 in positions they assume during normal operation of the apparatus. A control unit 2A controls the operation of the conveyor 2 so that the upper reach of this conveyor delivers a succession of discrete partially overlapping sheets 4 from a source of sheets in a direction indicated by the arrow 2D, i.e., toward and into the stacking station 6 so that the front edge of each sheet impinges upon and descends along the upright surface 20 of stop 8. The control unit 2A includes or is associated with an adjustable sheet sensor or counter 2B which can be of any suitable design and generates a signal whenever the conveyor 2 completes the delivery of a predetermined or preselected number of sheets 4, namely the desired number of sheets to be contained in a fully grown stack (see the stack 30 in FIG. 3, i.e., the sheets 4 between the pallet 12 and the section 38 of the finger 26). The conveyor 2 can receive a series of discrete sheets 4 from a station wherein one or more knives of a severing unit repeatedly cuts or cut across a running web of paper, metallic foil or the like.

The drive 32 (or a discrete second drive, not shown) begins to move the finger 26 downwardly (note the arrow 66 in FIG. 2) as soon as the section 38 has penetrated between the fully grown stack 30 and the lowermost sheet 4 of the next-following (growing) stack 76. The downward movement of the finger 26 and of its section 38 takes place at a speed less than the speed of downward movement of the pallet 12 with the fully grown stack 30; this is indicated by the lengths of the arrows 14 and 66 shown in FIG. 2. The positions of all other mobile parts shown in FIG. 2 remain the same as in FIG. 1.

Figure 3:
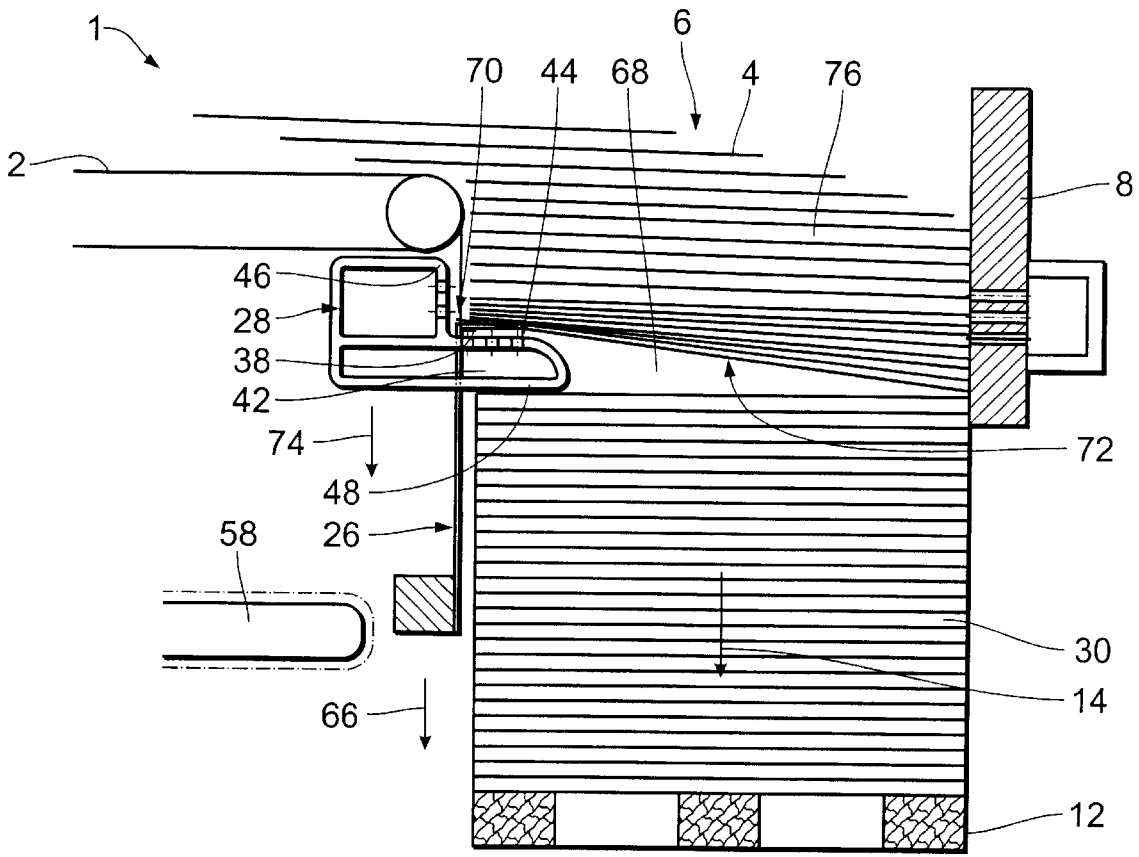
FIG. 3 shows the apparatus during a stage of operation which involves separation of the fully grown stack from the growing second stack and the establishment of a gap between the two stacks by a suction-operated partitioning member.

FIG. 3 shows that, due to a downward movement of the pallet 12 with the fully grown stack 30 thereon which is faster than the downward movement of the separating finger 26, the section 38 establishes a wedge-like clearance or gap 68 which narrows (due to flexibility of the sheets 4) in a direction from the aligning member 10 toward the stop 8. The next step involves the introduction of the stack partitioning member 28 into the left-hand portion of the gap 68 as soon as the height of such left-hand portion of the gap suffices to accept the projection 42 (see FIGS. 3 and 4).

The upright component 40 of the partitioning member 28 comes close to or actually abuts the adjacent trailing ends 70 of the lowermost sheets 4 forming part of the growing (second) stack 76 while the underside 72 of the lowermost sheet of the stack 76 abuts the upper side of the panel 44 (i.e., overlies the openings 46).

Figure 4:
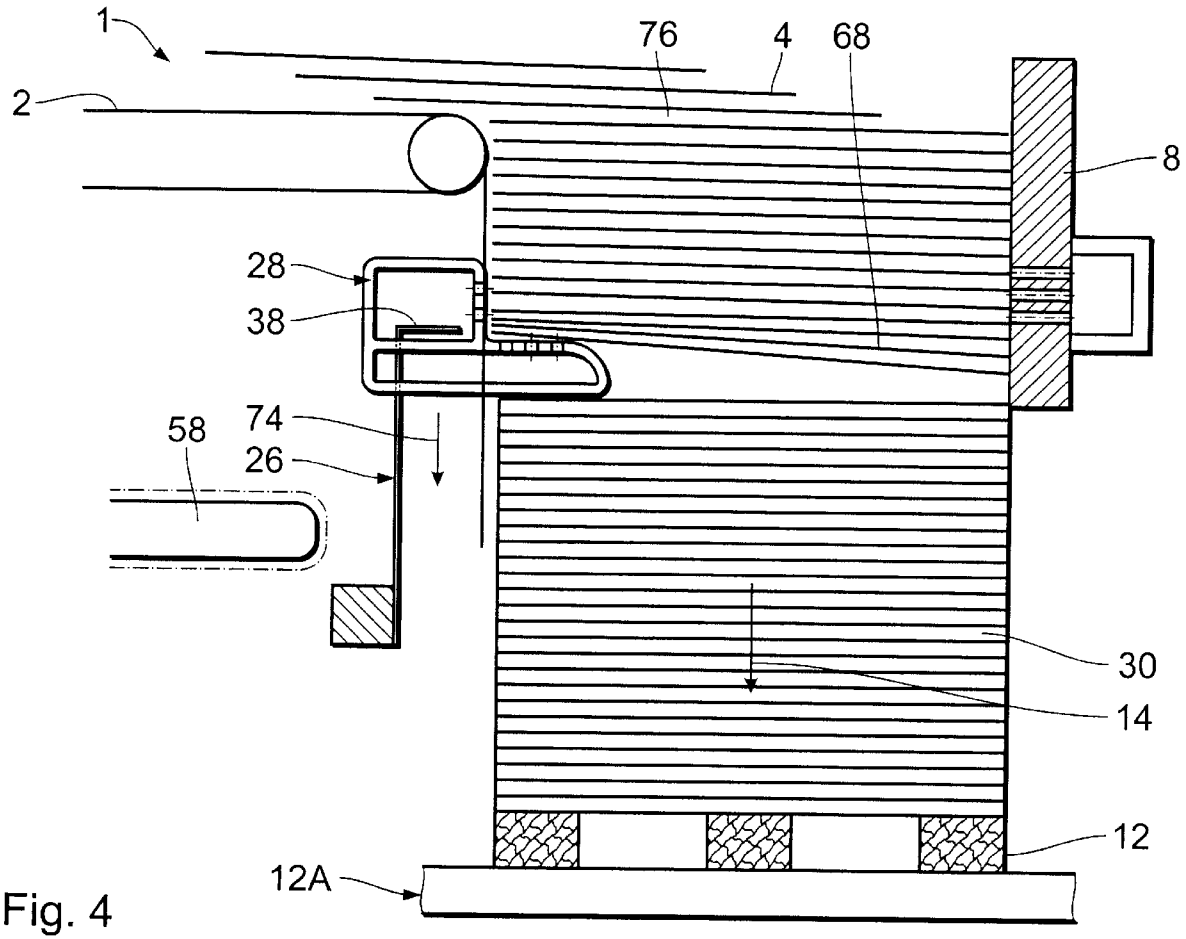
FIG. 4 shows the apparatus of FIGS. 1 to 3 during a stage of operation which follows retraction of the separating member from the stacking station.

Introduction of the partitioning member 28 into the gap 68 takes place simultaneously with or immediately precedes withdrawal of the horizontal section 38 of the separating finger 26 from the corresponding opening of the aligning member 10 (i.e., from the left hand-side of the pileup of sheets 72 then accommodated at the upright stacking station 6). This is shown in FIG. 4. The properly inserted partitioning member 28 begins to descend with the pallet 12 (see the arrow 74 in FIG. 4) as soon as the projection 42 completes its forward movement into the gap 68. Such downward movement in the direction of arrow 74 takes place simultaneously with downward movement of the stack separating finger 26 in the direction of arrow 66. The positions of all other members of the apparatus 1 (with the exception of of the continuously descending elevator 12A and of the continuously driven conveyor 2) remain unchanged.

The chambers 50 and 52 are connected to the suction pump 24A or to a discrete suction generating device while the separating finger 26 is being withdrawn, or immediately upon completed withdrawal of the finger 26, from the gap 68. Thus, the openings 56 draw atmospheric air through the upright section 40 of the member 28 and into the chamber 52; such air is drawn from eventual accumulations of air in the spaces (if any) between neighboring sheets 4 of the growing stack 76 while the exposed surface 54 abuts the foraminous (such as perforated or otherwise apertured) portion of the upright aligning member 10. Suction in the chamber 50 ensures that the openings 46 can cause the underside 72 of the lowermost sheet 4 of the growing stack 76 to adhere to the upper side of the panel 44 of the projection 42.

Figure 5:
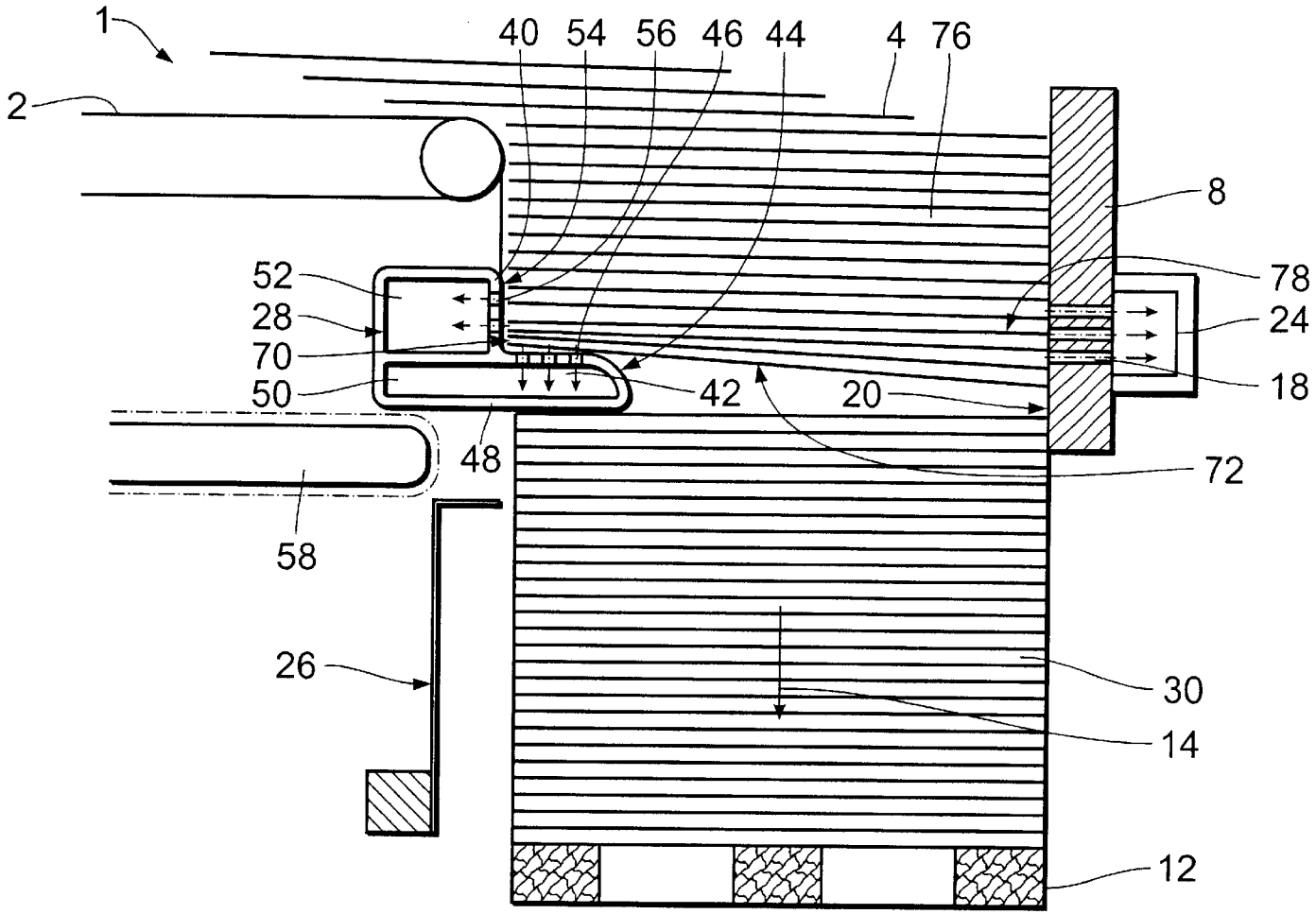
FIG. 5 illustrates the apparatus of FIGS. 1 to 4 during that stage of operation which involves attraction of a portion of the growing second stack to the partitioning member.

The suction pump 24A is activated simultaneously with the reduction of pressure in the chambers 50 and 52, i.e., the pressure of air in the chamber 24, in the openings 18 and at the surface 20 of the stop 8 is reduced below atmospheric (see FIG. 5). This ensures that the openings 18 can withdraw pockets of air between the adjacent front edges 78 of the sheets 4 forming part of the growing stack 76 and can pull such front edges against the surface 20. Still further, suction in the chamber 24 ensures that the front edges 78 of lowermost sheets 4 of the growing stack 76 cannot descend toward and onto the top sheet 4 of the fully grown stack 30.

The aforedescribed retention of lowermost sheets 4 of the growing stack 76 at the partitioning member 28 takes place while the separating finger 26 descends (in the direction of the arrow 14) with the pallet 12 and the fully grown stack 30 thereon. This results in a downward movement of the separating finger 26 to and beyond the position which is shown in FIG. 5, i.e., below the level of the table 58 (see FIG. 6).

Figure 6:
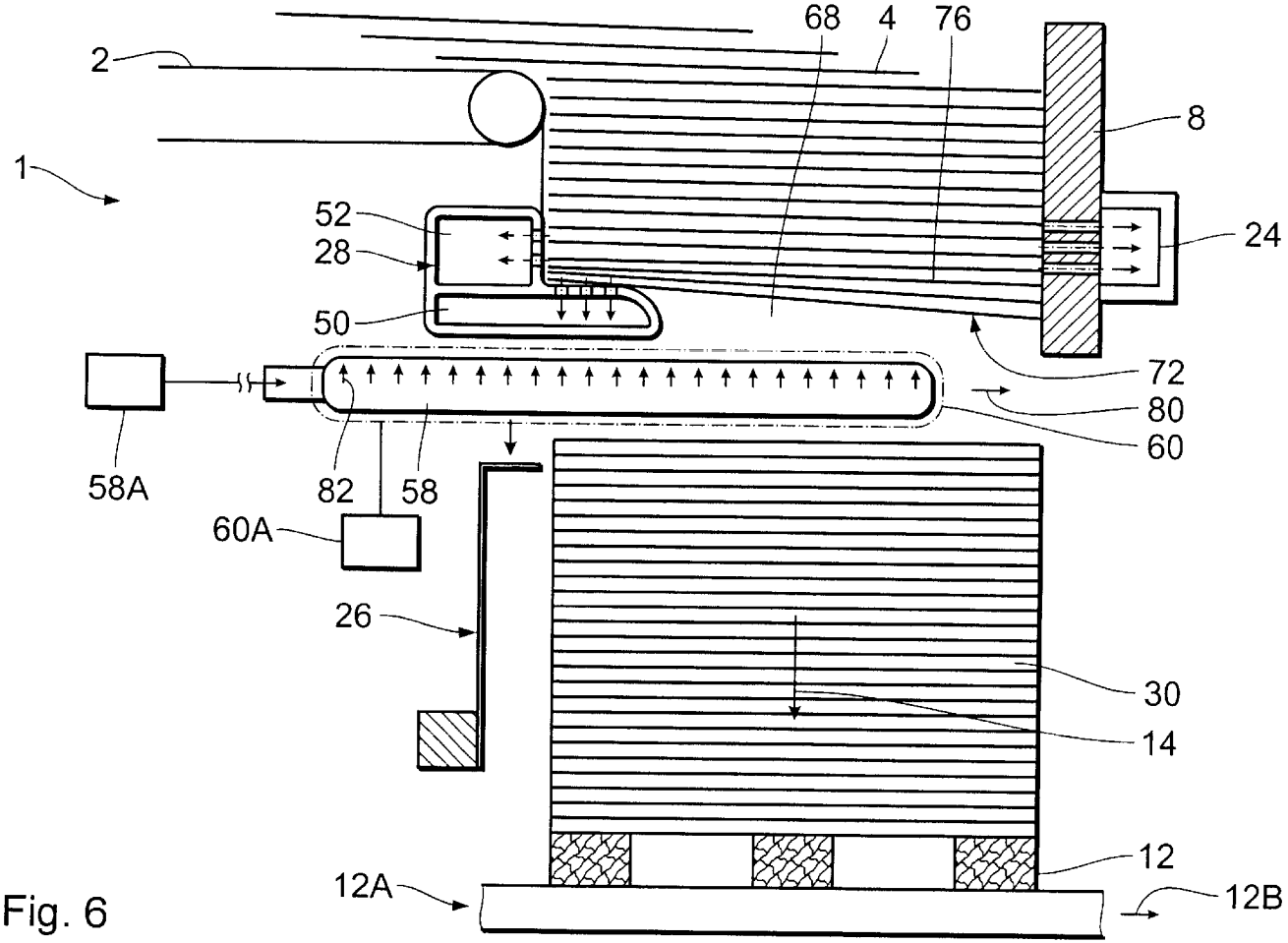
FIG. 6 shows the apparatus of FIGS. 1 to 5 with the distancing means in a position between the fully grown stack and the partially grown stack thereabove.

FIG. 6 shows that the elevator 12A lowers the pallet 12 in the direction of the arrow 14 at a speed which exceeds the speed of downward movement of the partitioning member 28 so that the width (actually height) of the clearance or gap 68 increases and reaches a predetermined value (exceeding the height of the distancing member including the table 58 and the cover 60) not later than when the gap portion below the level of the partitioning member 28 can readily receive (preferably with at least some clearance) the table 58 and its cover 60. The table 58 is thereupon introduced into the gap 68 beneath the partitioning member 28 by moving in the direction of arrow 80 in response to actuation of a prime mover 58A (e.g., a double-acting cylinder having a reciprocable piston or a carriage reciprocable along a suitable track, not shown). The suction chamber 24 and the chambers 50, 52 continue to draw air through the respective openings 18, 46 and 56.

Suction which is established in the chamber 24 ensures that the underside 72 of the lowermost sheet 4 in the growing stack 76 does not descend into contact with the table 58 and more particularly with the cover 60 the upper panel of which is advanced in the direction indicated in FIG. 1 by the arrow 64, i.e., counter to the direction (see the arrow 80 in FIG. 6) of entry of the table 58 into the gap 68 between the stacks 30 and 76. However, if the underside 72 of the lowermost sheet 4 of the growing stack 76 happens to come into contact with the envelope 60, this is compensated for in that the speed of the table 58 in the direction of the arrow 80 matches the speed of movement of the upper panel of the cover 60 in the direction of the arrow 64; this ensures that the position of the lowermost sheet 4 of the growing stack 76 (as seen in the direction in or counter to that indicated by the arrow 80) remains unchanged. Absence of sliding movement between the underside 72 of the lowermost sheet 4 of the growing stack 76 and the cover 60 is desirable and advantageous because this reduces the likelihood of providing the underside 72 of the lowermost sheet 4 of the stack 76 with lines, grooves, scratches and/or other undesirable formations as a result of contact with the cover 60.

In order to further reduce the likelihood of scoring and/or otherwise undesirably affecting the appearance of the underside 72 of the lowermost sheet 4 of the growing stack 76 above the table 58, it is desirable and advantageous to provide the upper side of the table 58 with ports or analogous openings which discharge streamlets 82 (see FIGS. 6 and 7) of compressed air or another gaseous fluid. Such fluid issues from one or more plenum chambers (not specifically shown in the drawing) and penetrates through the foraminous cover 60 to impinge upon the underside 72. If the cover 60 is impermeable to gases, the streamlets 82 urge the upper side of the upper panel of the cover against the underside 72.

Figure 7:
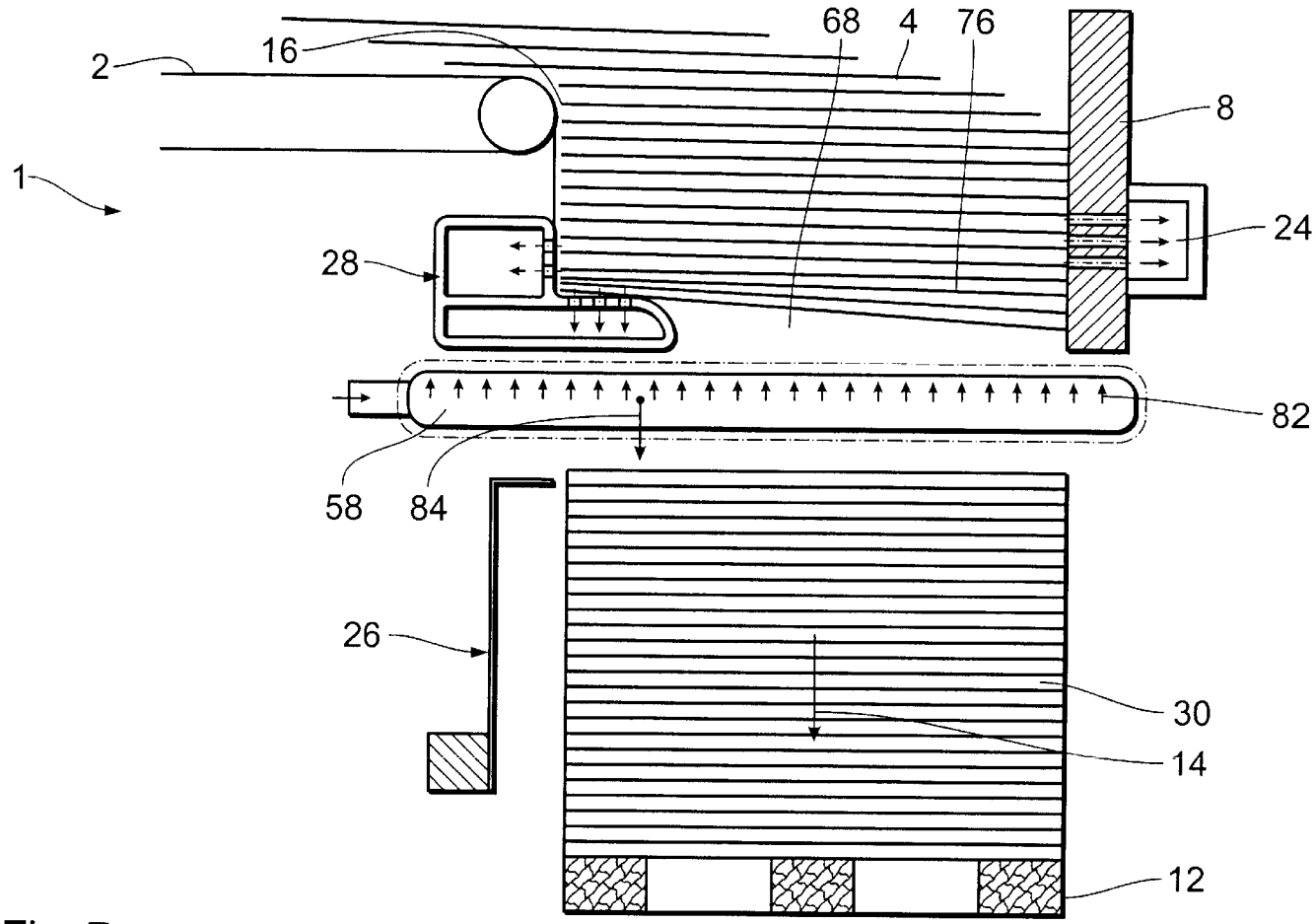
FIG. 7 illustrates the distancing means in a fully inserted position.

When the table 58 reaches the front end position which is shown in FIG. 7 (or even before such time), it is lowered by its support, together with the partitioning member 28, at a rate which is required to ensure that the uppermost sheet 4 of the stack 76 between the stop 8 and the aligning member 10 is maintained at the level 16, i.e., at the desired or required level relative to the upper reach of the conveyor 2.

Figure 8:
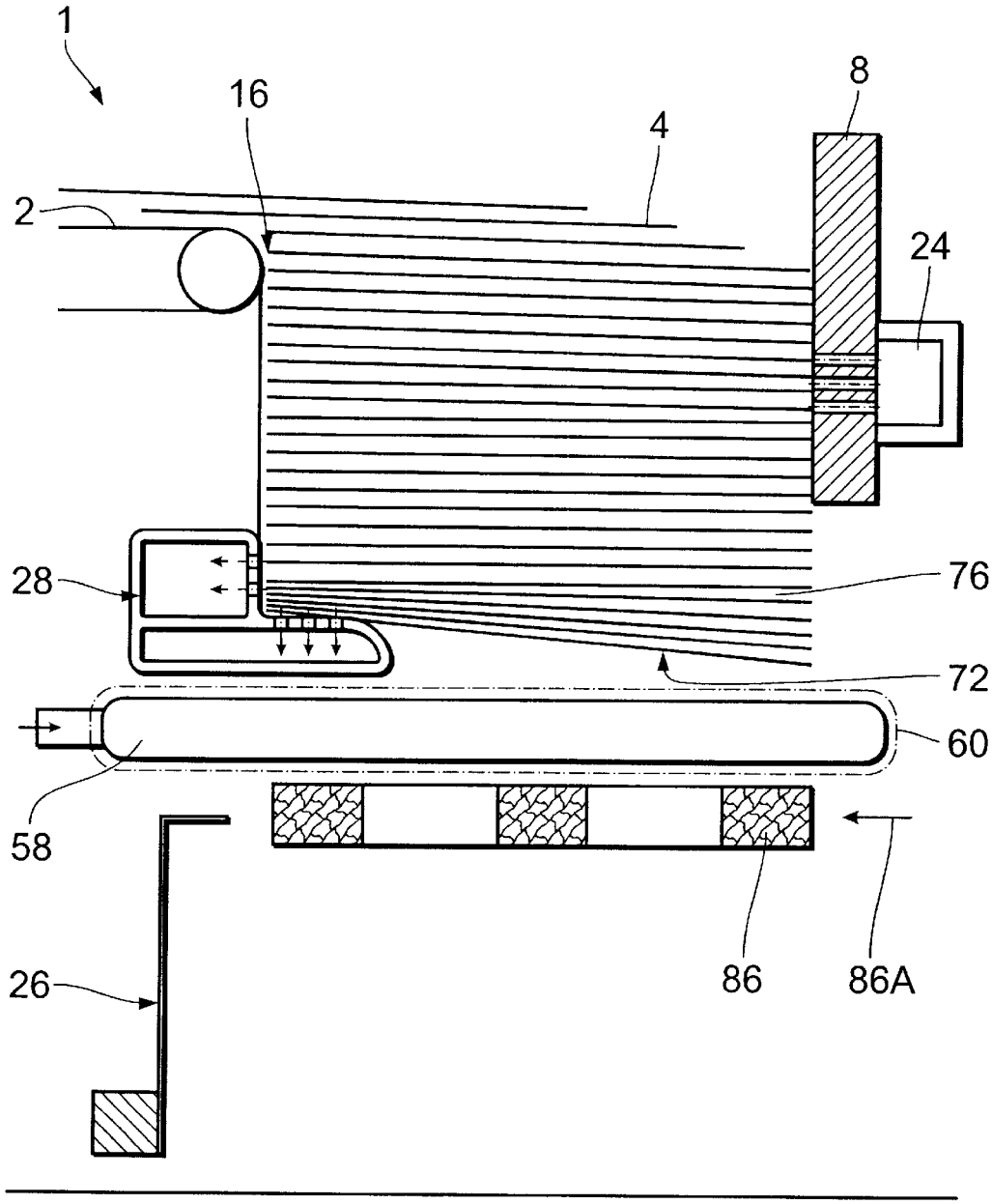
FIG. 8 shows the apparatus with its parts in positions they assume upon removal of a platform with a fully grown stack thereon and introduction of an empty platform.
Figure 9:
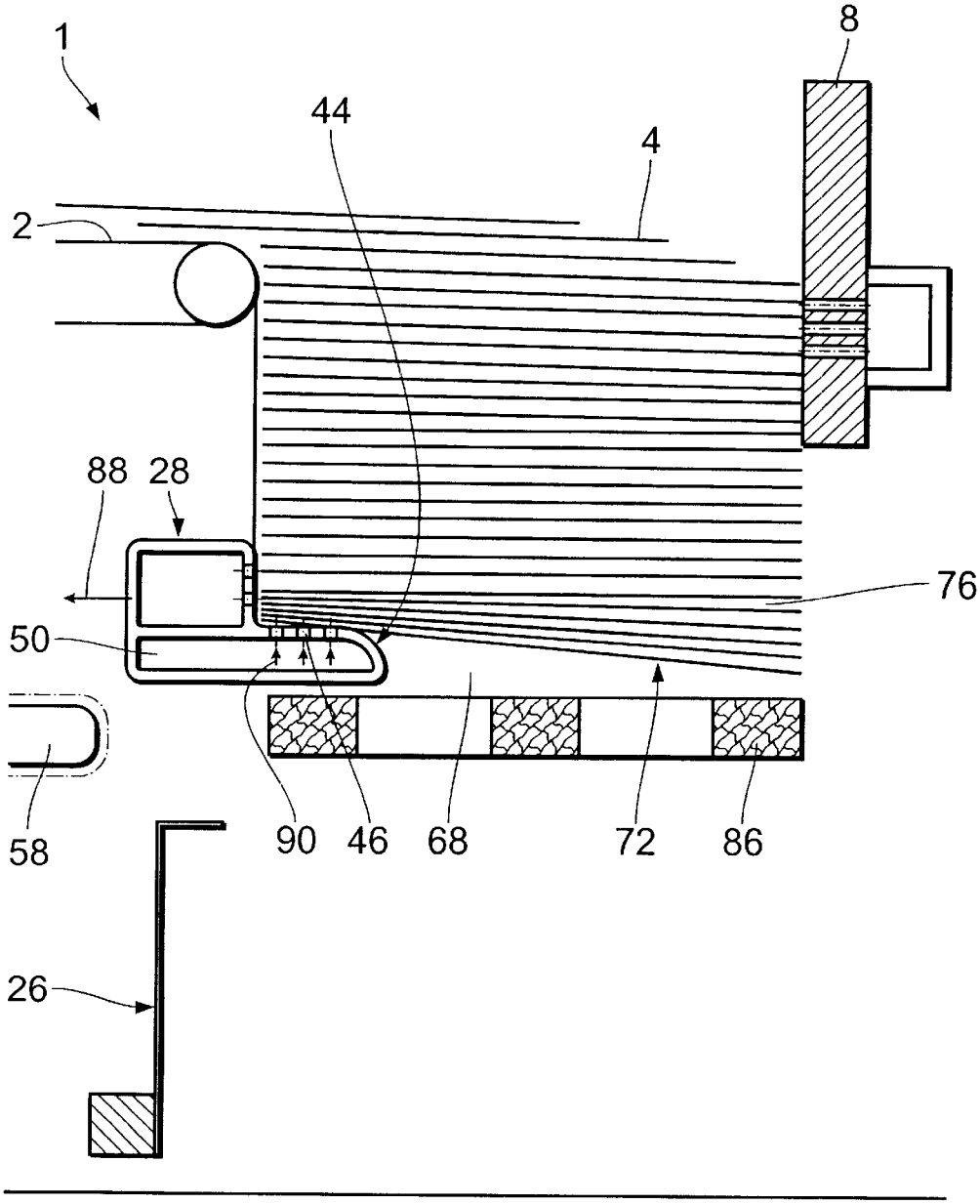
FIG. 9 illustrates the apparatus with the partitioning member on its way toward the empty platform.

The next step involves the transport of fully grown stack 30 out of the apparatus 1, e.g., to the right, as viewed in FIG. 7. The stack 76 continues to descend in a manner as described hereinbefore with reference to the stack 30, and such downward movement is shared by the partitioning member 28 and the table 58. Lowering of the stack 76 ensures that successive uppermost sheets 4 of this stack are located at the level 16. A fresh pallet (see the pallet 86 in FIG. 8) is introduced into the stacking station 6 beneath the table 58, and such introduction is preceded by disconnection of the suction chamber 24 from the suction pump 24A so that the stop 8 cannot interfere with downward movement of the stack 76. Furthermore, in the apparatus 1 the table 58 ceases to discharge jets (82) of compressed air or another gaseous fluid toward the underside of the stack 76 when the fresh pallet 86 assumes the position which is shown in FIG. 8. However, it is equally within the purview of the instant invention to continue with the discharging of jets 82 while the table 58 is being moved from the position of FIG. 8 to that which is shown in FIG. 9, to the left of the separating finger 26 and to a level nearer to that of the conveyor 2. Thus, the directions of movement of the table 58 are reversed in comparison with the directions of movement from the position shown in FIG. 1 to that which is depicted in FIG. 8. Moreover, the cover 60 is also moved relative to the table 58, namely in a direction to avoid any sliding movements between the lowermost sheet of the stack 76 and the upper panel of the cover.

Figure 10:
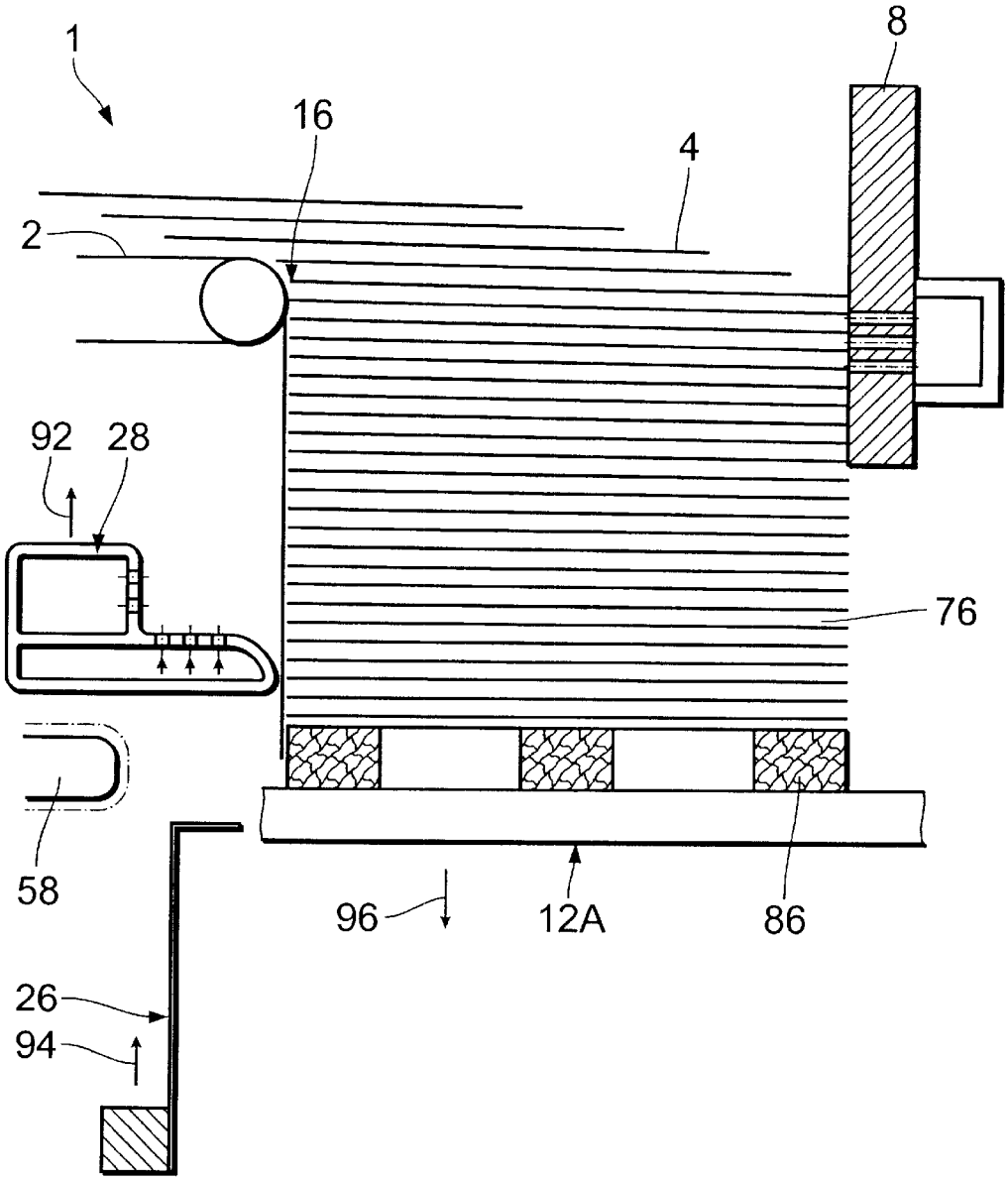
FIG. 10 shows the apparatus with its partitioning member in retracted position and the fully grown second stack directly supported by the second platform.

FIG. 9 shows the fresh pallet 86 in the position previously occupied by the table 58. Thus, the distance between this pallet and the underside 72 of the lowermost sheet 4 of the stack 76 is minimal. The pallet 86 is advanced to the position of FIG. 9 simultaneously with retraction of the partitioning member 28 from the gap 68 in the direction of the arrow 88; this results in deposition of the stack 76 on the pallet 86 (see FIG. 10). In order to facilitate retraction of the member 28 from the underside 72 of the lowermost sheet 4 of the stack 76, the source 50A (FIG. 1) is caused to admit compressed air or another gas into the chamber 50 so that the openings 46 discharge jets 90 (see FIG. 9) of compressed gas. Such mode of extracting the member 28 from the gap 68 reduces the likelihood of any, or of any appreciable, frictional engagement between the member 28 and the underside 72. This is desirable because the likelihood of scoring and/or otherwise adversely affecting the appearance of the underside 72 is reduced to a minimum.

The partitioning member 28 is thereupon lifted to its starting position (see the arrow 92 in FIG. 10) and the finger 26 is lifted in the direction of arrow 94. This completes the placing of the apparatus 1 into the condition shown in FIG. 1 except that the pallet 12 is replaced with the pallet 86. The arrow 96 denotes in FIG. 10 the direction of downward movement of the fresh pallet 86 with the elevator 12*a*. From then on, the stack 76 is treated in the same way as described above with reference to the stack 30 and as shown in FIGS. 1 to 7, i.e., the stack 76 is caused to grow into a full-sized stack, a third stack is caused to grow at a level above but spaced apart from the stack 76, the fully grown stack 76 is removed from the apparatus, a third pallet is deposited on the elevator 12A, and so forth.

An advantage of the improved apparatus 1 is that it is no longer necessary to clamp a fully grown stack between two jaws in a manner as disclosed in the afore-discussed published German patent application Serial No. 36 16 470 A1 of Martini et al. Instead, the lowermost sheet 4 of the growing stack 76 is attracted to the partitioning member 28 by suction. In other words, it is not necessary to compress the stack 30, the stack 76 and the next-following stacks. The operation of the improved apparatus 1 is simpler than that of the apparatus proposed in the German patent application of Martini et al. because it is not necessary to employ two clamping jaws and/or the mechanisms which move the clamping jaws toward and away from and with each other.

The suction chambers 24 and 52 enable the stop 8 and the section 40 of the partitioning member 28 to attract the adjacent sheets 4 because the recently developed web severing apparatus (i.e., the apparatus which can be utilized to subdivide a running web into a continuous series of sheets 4) are capable of furnishing sheets with front and rear edge faces 4*a*, 4*b* (FIG. 1) of such smoothness that, when the sheets are piled up on each other, the corresponding front and rear sides of the stacks 30, 76, etc. are sufficiently smooth to enable streamlets of air flowing into the openings 18 and 56 to adequately attract the respective stacks 30, 76, etc. to the surfaces 20 and 54 as long as the respective suction chambers 24, 52 are connected to the suction pump 24A and/or to other suction generating means.

The feature that the gap 68 and the next-following gaps can be formed by causing the finger 26 to descend at a speed less than the speed of downward movement of the preceding stack (compare the FIGS. 2 and 3) renders it possible to form gaps of optimum width (height) in a simple but efficient and time-saving manner.

As can be seen in FIGS. 3 and 4, the section 38 of the finger 26 can be withdrawn from the gap 68 as soon as the height of this gap (at the left-hand side of the station 6) is sufficient to ensure unimpeded introduction of the projection 42 of the partitioning member 28, i.e., such withdrawal of the section 38 can take place simultaneously with or immediately following the introduction of projection 42 into the gap 68. However, it is equally within the purview of the invention to combine the finger 26 with the partitioning member 28 so that the finger can move in an aperture of the partitioning member.

The means for drawing air from the chamber 52 and/or 56 can include a blower having a suction side connected or connectable to the sections 40, 48 of the partitioning member 28, a pump (such as the pump 24A) or any other suitable suction generating means in association with valves which are controlled by the unit 2A to attract the edge faces and/or the undersides (72) of certain sheets during predetermined stages of operation of the apparatus 1.

The provision of the means (46, 56) for attracting the undersides (72) of selected sheets 4 to the panel 44 of the section 48 of the partitioning member 28 constitutes a desirable feature of the present invention. The utilization of the source 50A of compressed air in conjunction with the chamber 50 and openings 46 renders it possible to simplify the apparatus 1 because the means (50, 50A, 46) for urging sheets 4 away from the partitioning member 28 includes parts (50, 56) of the means (50, 52, 46, 56) for attracting sheets to the member 28.

The suction chamber 52 can be utilized in addition to or in lieu of the suction chamber 50. It is often preferred to provide the partitioning member 28 with both chambers, i.e., to enable the member 28 to temporarily attract the underside (72) of the lowermost sheet 4 of a growing stack as well as the rear side of such stack, to attract only the underside of the lowermost sheet or to attract only the rear side of the stack.

A substantially L-shaped partitioning member 28 (with mutually inclined sections 40, 48) is ideally suited to simultaneously attract the underside as well as the rear side of a growing stack (such as the stack 76 in FIG. 5) in order to ensure that the stack is temporarily held against movements relative to the member 28. The reason is that the stack can be maintained in large-area contact with the member 28.

The cover 60 can constitute a sheet or strip or endless band of flexible material which may but need not be permeable to gases.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art of accumulating successive stacks of superimposed sheets on pallets or the like and, therefore, such adaptations should and are intended to be comprehended within the meaning and range of equivalence of the appended claims.

What is claimed is:

1. A method of supplying platforms for stacks of a series of successive sheets which are supplied to and are superimposed upon each other at a stacking station, comprising the steps of:

depositing successive sheets of the series upon a first platform at the stacking station to thus accumulate on the first platform a first stack of superimposed sheets, including lowering the first platform with the growing stack of sheets thereon;

introducing a stack separating member sideways between a topmost sheet of the first stack and the next-following sheet of the series utilizing the separating member to establish between the topmost sheet of the first stack and the next-following sheet of the series a gap;

inserting a partitioning member between the separating member and the top-most sheet of the first stack, withdrawing the separating member from the stacking station so that the next-following sheet of the series is free to descend onto the partitioning member;

attracting the next-following sheet to the partitioning member by suction;

increasing the width of the gap between the partitioning member and the first stack;

advancing a distancing member into the thus widened gap;

evacuating the first stack and the first platform from the stacking station;

transporting into the stacking station a second platform beneath the distancing member;

removing the distancing member from the stacking station;

interrupting the attracting step; and retracting the partitioning member from the stacking station so that the next-following sheet and the sheets thereabove can descend onto the second platform.

2. The method of claim 1, wherein said depositing step includes conveying successive sheets of the series into the stacking station in a predetermined direction transversely of the direction of lowering the stacks of sheets at the stacking station, said introducing step including moving the separating member into the stacking station in said predetermined direction.

3. The method of claim 1, wherein said width increasing step includes lowering the first stack at the stacking station at a first speed and lowering the separating member at the stacking station at a second speed less than said first speed.

4. The method of claim 1, wherein said inserting step is carried out simultaneously with said withdrawing step.

5. The method of claim 1, wherein said width increasing step is carried out subsequent to said withdrawing step.

6. The method of claim 1, wherein said attracting step includes drawing air into openings provided in the partitioning member.

7. The method of claim 1, wherein said attracting step includes drawing the underside of the next-following sheet of the series to an upper side of an apertured panel of the partitioning member.

8. The method of claim 1, wherein said attracting step is started upon deposition of at least one additional sheet of the series upon the next-following sheet.

9. The method of claim 8, wherein the next-following sheet and the at least one additional sheet and the sheets thereabove form part of a growing second stack, said attracting step further including attracting at least a portion of the growing second stack to the partitioning member.

10. The method of claim 1, wherein said depositing step includes propelling successive sheets of the series against a stop at the stacking station, and further comprising the step of temporarily attracting the thus propelled successive sheets to the stop by suction.

11. The method of claim 1, wherein the distancing member comprises a core movable into and from the stacking station and a cover movable with and relative to the core between the core and the next-following sheet, said advancing step including moving the core into the widened gap and simultaneously moving the cover relative to the core so that the speed of movement of the cover relative to the next-following sheet approximates zero speed.

12. The method of claim 1, further comprising the step of establishing a film of a compressed gaseous fluid between the distancing member and the cover.

13. Apparatus for supplying platforms for stacks of a series of successive sheets at a stacking station, comprising:

means for conveying to the stacking station a series of successive sheets which are superimposed upon each other;

an elevator arranged to support a platform at the stacking station and to lower the platform thereon at a predetermined speed so that a growing stack of superimposed sheets supplied by said conveying means onto the platform descends at said station;

a separating member arranged to be introduced into said station between the uppermost sheet of a fully grown stack on the platform and the lowermost sheet of a growing next-following stack;

means for lowering the introduced separating member at a speed less than said predetermined speed to thus establish a growing gap between the uppermost sheet of the fully grown stack and the lowermost sheet of the growing next-following stack;

a partitioning member movable between a first position adjacent to and a second position within said gap as well as downwardly in said gap at a speed less than said predetermined speed to thus further increase the gap;

means for temporarily attracting the lowermost sheet of the next-following stack to said partitioning member; and a distancing member movable between a first position adjacent to and a second position in the increased gap.

14. The apparatus of claim 13, wherein said conveying means is arranged to supply to the stacking station an at least substantially continuous series of sheets and said attracting means has openings provided in said partitioning member and arranged to attract sheets at said station to at least one selected portion of said partitioning member.

15. The apparatus of claim 14, wherein said partitioning member includes mutually inclined sections.

16. The apparatus of claim 15, wherein one of said sections has an upper side and said attracting means further includes at least one suction chamber in said partitioning member, said openings including suction ports provided in said upper side of said one section, communicating with said at least one suction chamber and arranged to attract the underside of the lowermost sheet of the next-following stack at said station.

17. The apparatus of claim 14, wherein said openings include ports arranged to attract one side of the next-following stack at said stacking station.

18. The apparatus of claim 14, wherein said attracting means includes at least one suction chamber provided in said partitioning member and said openings include suction ports communicating with said at least one suction chamber.

19. The apparatus of claim 13, further comprising means for urging sheets away from said partitioning member.

20. The apparatus of claim 19, where in said means for urging sheets away from said partitioning member includes parts of said attracting means.

21. The apparatus of claim 19, wherein said means for urging sheets away from said partitioning member includes a source of compressed air arranged to supply compressed air to openings forming part of said attracting means and provided in said partitioning member.

22. The apparatus of claim 13, wherein said distancing member has openings on the side facing the underside of the lowermost sheet of the growing stack at said station in the second position of said distancing member, and further comprising means for supplying to said openings a compressed gaseous fluid in the second position of said distancing member.

23. The apparatus of claim 22, wherein said distancing member includes a core provided with said openings and a cover overlying said openings and immediately adjacent the lowermost sheet of the growing stack at said station in the second position of said distancing member.

24. The apparatus of claim 23, wherein said cover is impermeable to fluids.

25. The apparatus of claim 23, further comprising means for moving said core and said cover relative to each other so that the speed of the cover relative to the lowermost sheet of the growing stack during movement of the core from said second position to said first position approximates zero speed.

* * * * *